US007168641B2

(12) United States Patent
Filgueiras

(10) Patent No.: US 7,168,641 B2
(45) Date of Patent: Jan. 30, 2007

(54) ATTRITION SCRUBBER APPARATUS AND METHOD

(75) Inventor: Marcos Filgueiras, Pittsford, NY (US)

(73) Assignee: SPX Corporation, Charlotte, NC (US)

( * ) Notice: Subject to any disclaimer, the term of this patent is extended or adjusted under 35 U.S.C. 154(b) by 43 days.

(21) Appl. No.: 10/929,566

(22) Filed: Aug. 31, 2004

(65) Prior Publication Data

US 2006/0043223 A1 Mar. 2, 2006

(51) Int. Cl.
*B02C 23/36* (2006.01)

(52) U.S. Cl. ..... 241/43; 241/46.17

(58) Field of Classification Search ..... 241/20, 241/21, 42, 41, 43, 26, 29, 46.11, 46.17, 284
See application file for complete search history.

(56) References Cited

U.S. PATENT DOCUMENTS

| | | | | |
|---|---|---|---|---|
| 3,446,442 | A * | 5/1969 | Carter | 241/15 |
| 4,098,465 | A * | 7/1978 | Meller et al. | 241/43 |
| 4,434,942 | A * | 3/1984 | Cardini | 241/21 |
| 4,468,130 | A | 8/1984 | Weetman | |
| 5,328,105 | A * | 7/1994 | Sims et al. | 241/46.17 |

* cited by examiner

*Primary Examiner*—Faye Francis
(74) *Attorney, Agent, or Firm*—Baker & Hostetler LLP

(57) ABSTRACT

An attrition scrubber that includes multiple attrition scrubber cells. The multiple attrition scrubbers cells are arranged generally parallel to a vertical axis of rotation. The apparatus includes a shaft that extends generally parallel to the vertical axis of rotation and through the center of all attritioning cells. Each attritioning cell contains two impellers having a diameter. The impellers are attached to the common shaft and positioned a distance apart from each other. Each cell also contains a distribution ring and radial baffles. The attrition scrubber apparatus also includes a lifter impeller having a diameter.

22 Claims, 4 Drawing Sheets

ATTRITION SCRUBBER APPARATUS AND METHOD

FIELD OF THE INVENTION

The present invention relates generally to an apparatus and method for attrition scrubbing. More particularly, the present invention relates, for example, to a reduced wear attrition scrubber having a small footprint that provides controlled residence time and minimal vortexing.

BACKGROUND OF THE INVENTION

Attrition scrubbers are in wide use in industry and are typically employed in processes such as particle cleaning or the like. For example, the glass industry has utilized attrition scrubbers for many years to remove surface contamination from silica sands in order to improve the clarity in glass. Attrition scrubbers operate to effectively remove the surface contamination by rubbing or grinding down the particles. The aforementioned rubbing or grinding down creates friction forces, also known as shear forces, which separate the undesired contamination from the desired glass.

Attrition scrubbing, specifically hydraulic shear attrition scrubbing, is a process by which particles are scrubbed by thrusting the individual particles into one another at high speeds. The friction created by the high speed collisions functions to effectively shear the undesired material, for example surface contamination, from the desired material. Due to the aforementioned collisions and resulting friction, little wear occurs on the machine itself because scrubbing is accomplished by friction that is created by particle-to-particle collision, not machine-to-particle collision.

Oftentimes the aforementioned scrubbing process may require multiple stages depending upon the desired degree of separation or desired process staging. In these multiple stage processes, both the undesired material and the desired material are combined into a single medium. The medium is then subject to a series of attrition stages. As the medium graduates from stage to stage, a higher degree of separation is achieved among the desired and undesired material.

One way of achieving the desired degree of separation involves employing multiple attritioning cells in a side-by-side arrangement. In these arrangements, each attritioning cell usually has two oppositely arranged impellers mounted to a rotatable shaft. As the impellers are rotated, they force the liquid medium to flow in opposing axial directions, thereby creating particle-on-particle impact.

The aforementioned multiple staging processes have drawbacks however. The multiple staging attrition scrubbers are typically configured wherein the cells are positioned in a side-by-side arrangement, causing the attrition scrubbers to have a very large footprint and consume a large amount of floor space. Also, due to this side-by-side arrangement, multiple shafts and multiple attrition drive motors are required, which can be costly. Also, in order to obtain the desired degree of separation, a large amount of energy must be transferred to the particles. This energy transfer is typically accomplished by rotating the impellers at very high speeds, which consumes a large amount of energy. Thus, the more shafts that must be rotated at a high rate of speed, the more energy that is consumed during operation of the attrition scrubber.

Accordingly, it is desirable to provide an energy efficient attrition scrubber apparatus and method having a reduced footprint that achieves a desired degree of separation.

SUMMARY OF THE INVENTION

The foregoing needs are met, to a great extent, by the present invention, wherein aspects of an attrition scrubber apparatus and method are provided.

In accordance with one aspect of the present invention, an attrition scrubber for attritioning a fluid having a vertical axis of rotation. The apparatus comprises a first attritioning cell located generally along the vertical axis of rotation having an inlet opening and a width $W_{cell}$. The apparatus also includes a second attritioning cell located generally along the vertical axis of rotation at a position adjacently above the first attritioning cell, wherein the second attritioning cell has a width equal to $W_{cell}$. The apparatus further includes a rotatable shaft disposed within the first and second attritioning cells, wherein the rotatable shaft extends generally parallel to and rotates about the vertical axis of rotation at least partially all the way between first and second attritioning cells. A first impeller is attached to the rotatable shaft at a first axial location within the first attritioning cell, wherein the first impeller pumps fluid along the vertical axis of rotation in a first direction. A second impeller is attached to the rotatable shaft at a second axial location within the first attritioning cell, wherein the second impeller pumps fluid along the axis of rotation in a second, opposite direction. A third impeller is attached to the rotatable shaft at a third axial location within the second attritioning cell, wherein the third impeller pumps fluid along the vertical axis of rotation in the first direction. A fourth impeller is attached to the rotatable shaft at a fourth axial location within the second attritioning cell, wherein the fourth impeller pumps fluid along the vertical axis of rotation in the second, opposite direction. The first, second, third, and fourth impellers each have a diameter $D_i$.

In accordance with another embodiment of the present invention, an attrition scrubber for attritioning a fluid having a vertical axis of rotation. The apparatus comprises a first attritioning cell located generally along the vertical axis of rotation having an inlet opening and a diameter $D_{cell}$. The apparatus also includes a second attritioning cell located generally along the vertical axis of rotation at a position adjacently above the first attritioning cell, wherein the second attritioning cell has a diameter equal to $D_{cell}$. The apparatus further includes a rotatable shaft disposed within the first and second attritioning cells, wherein the rotatable shaft extends generally parallel to and rotates about the vertical axis of rotation at least partially all the way between first and second attritioning cells. A first impeller is attached to the rotatable shaft at a first axial location within the first attritioning cell, wherein the first impeller pumps fluid along the vertical axis of rotation in a first direction. A second impeller is attached to the rotatable shaft at a second axial location within the first attritioning cell, wherein the second impeller pumps fluid along the axis of rotation in a second, opposite direction. A third impeller is attached to the rotatable shaft at a third axial location within the second attritioning cell, wherein the third impeller pumps fluid along the vertical axis of rotation in the first direction. A fourth impeller is attached to the rotatable shaft at a fourth axial location within the second attritioning cell, wherein the fourth impeller pumps fluid along the vertical axis of rotation in the second, opposite direction. The first, second, third, and fourth impellers each have a diameter $D_i$.

In accordance with another aspect of the present invention, a method for attritioning a fluid, using an attrition scrubber having a rotatable shaft that rotates about a vertical axis of rotation. The rotatable shaft extends between a first attritioning cell and a second attritioning cell of the attrition scrubber. The method includes the step of directing fluid into the first attritioning cell via an inlet. The first attritioning cell comprises a first impeller attached to the rotatable shaft at a first axial location within the first attritioning cell and a second impeller attached to the rotatable shaft at a second axial location within the first attritioning cell. The method also includes the step of pumping the fluid along the vertical axis of rotation into the second attritioning cell. The second attritioning cell comprises a third impeller attached to the rotatable shaft at a third axial location within the second attritioning cell, and a fourth impeller attached to the rotatable shaft at a fourth axial location within the second attritioning cell.

In accordance with yet another aspect of the present invention, an attrition scrubber is provided for attritioning a fluid, having a rotatable shaft that rotates about a vertical axis of rotation, wherein the rotatable shaft extends between a first attritioning cell and a second attritioning cell of the attrition scrubber. The attrition scrubber comprises means for directing fluid into the first attritioning cell via an inlet, wherein the first attritioning cell comprises a first means for pumping the fluid attached to the rotatable shaft at a first axial location within the first attritioning cell, a second means for pumping the fluid attached to the rotatable shaft at a second axial location within the first attritioning cell, means for directing the fluid along the vertical axis of rotation into the second attritioning cell. The second attritioning cell comprises a third means for pumping the fluid attached to the rotatable shaft at a third axial location within the second attritioning cell and a fourth means for pumping the fluid attached to the rotatable shaft at a fourth axial location within the second attritioning cell.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
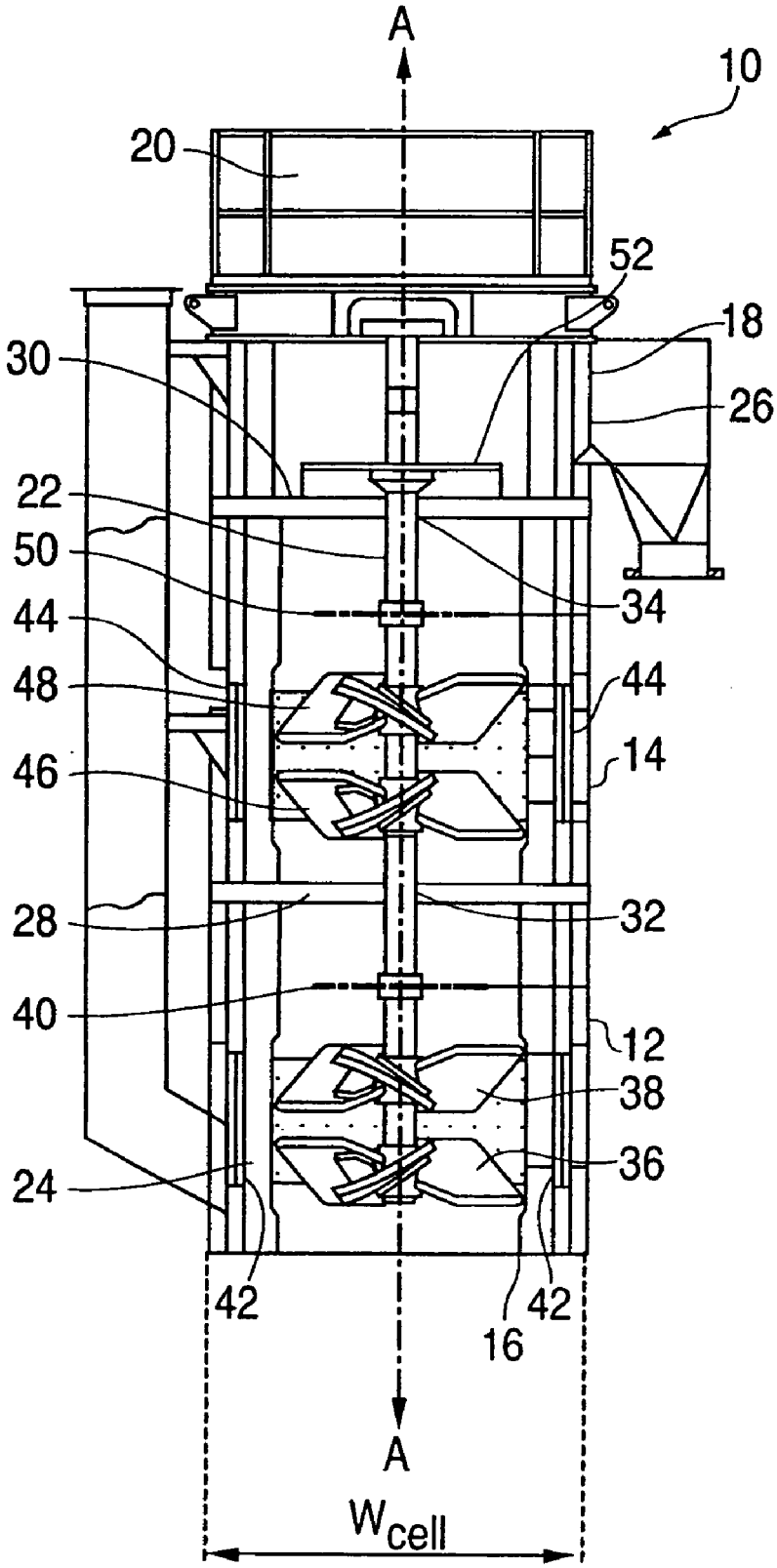
FIG. 1 is a side sectional view of an attrition scrubber in accordance with a preferred embodiment of the present invention.

Various embodiments of the present invention provide for an attrition scrubber apparatus and method for attritioning and/or cleaning various particles or the like. In some arrangements, for example, the attrition scrubber apparatus is utilized in various cleaning processes employed in the glass industry. It should be understood, however, that the present invention is not limited in its application to the glass industry or to cleaning processes, but, for example, can be used in other processes or industries that utilize the attritioning of particles or the like. The invention will now be described with reference to the drawing figures, in which like reference numerals refer to like parts throughout.

Referring now to FIG. 1, an attrition scrubber is provided, generally designated 10, having a first and second attritioning cell 12, 14 and an axis of rotation A. As illustrated in FIG. 1, the attritioning cells 12, 14 are preferably positioned vertically adjacent to one another along the axis of rotation A. The cells 12, 14 preferably have a square cross-sectional areas and are made of steel or iron, however they may be constructed from any material that is functionally equivalent to steel or iron. Though the attritioning cells 12, 14 preferably have square cross-sections, alternative embodiments of the present invention may include the varying of configurations, for example, cylindrical or octagonal configurations. The cells 12, 14 each have a respective inner surface. The inner surfaces are preferably coated with a rubber lining that is approximately ½ inch thick. It will be appreciated that the cells 12, 14 may be coated with synthetic resin instead of rubber or any other functionally equivalent coating. Also, it will be appreciated that the inner surface of the cells 12, 14 are not coated or covered. The attritioning apparatus 10 preferably rests on a base 16. The base 16 is preferably a channel base having a square or rectangular surface area on which the first attritioning cell 12 rests.

As depicted in FIG. 1, the attrition scrubber 10, also includes a top chamber 18 positioned adjacently above to the second cell 14, also along the vertical axis of rotation A. The attrition scrubber 10 further includes a drive means 20 that drives the rotatable shaft 22. The drive means 20 is preferably an electric motor, however alternative motors or means for driving may be employed. As illustrated in FIG. 1, the rotatable shaft 22 is attached to the drive means 20 by mechanical attachment and extends through the second cell 14 and into the first cell 12 where it extends at least part of the way through the first cell 12. The attritioning apparatus 10 also includes an apparatus inlet 24 and an apparatus outlet 26. The inlet 24 functions to feed a liquid medium, which typically contains both the desired and undesired material, into the first attritioning cell 12, while the outlet 26 allows the liquid medium to exit the attritioning apparatus via the top chamber 18. While FIG. 1 illustrates an attrition scrubber 10 that employs two cells 12, 14, the attrition scrubber 10 may employ more or less attritioning cells. The degree of separation that is achieved among the desired and undesired material varies, in part, according to the number of attritioning cells employed.

As previously described, alternative embodiments of the present invention may include an attrition scrubber 10 having more than two vertically arranged attritioning cells. In such arrangements, the shaft 22 extends through all of the cells, similar to the two cell arrangement previously described.

As depicted in FIG. 1, the attritioning apparatus 10 further includes first and second orifice plates 28, 30. The orifice plates 28, 30 are preferably solid metal plates with a circular hole 32, 34 punched in their respective centers. The orifice plates 28, 30, like the individual attritioning cells 12, 14, are preferably constructed of steel or iron however they may be composed of any material that is functionally equivalent to steel or iron. The first orifice plate 28 functions to separate the first and second cells 12, 14, while at the same time, it allows the liquid medium to pass from the first cell 12 through its circular hole 32 or orifice, into the second cell 14. The second orifice plate 30 separates the second cell 14 and the top chamber 18. The second plate 30 allows the liquid medium to pass from the second cell 14 through its circular hole 34 or orifice, into the top chamber 18.

As illustrated in FIG. 1, the first cell 12 includes a first and second impeller 36, 38. The first impeller 36 pumps the liquid medium in a first axial direction and the second impeller 38 pumps the liquid medium in a second, opposite axial direction. The first and second impellers 36, 38 are preferably arranged in an opposing relationship along the rotatable axis such that they are immediately adjacent to one another. More specifically, the impellers 36,38 may be connected to the rotatable shaft 22 at axial locations within the first cell 12, wherein they are separated by a distance equal to approximately 0.20 $W_{cell}$ to approximately 0.40 $W_{cell}$, where $W_{cell}$ is the width of the cell 12. More preferably the impellers 36, 38 are separated by a distance of approximately 0.27 $W_{cell}$. The above-describe arrangements provide a principal flow direction that is generally parallel to the axis of rotation A. The aforementioned arrangements also assist in the impacting of particles against one another. During operation of the attrition scrubber apparatus 10, the first impeller 36 pumps the liquid medium in the first direction toward the second impeller 38 while the second impeller 38 pumps the liquid medium in the second direction toward the first impeller 36. This action results in particle-on-particle scrubbing.

As illustrated in FIG. 1, the attrition scrubber apparatus 10 further includes a first dispersion ring 40 located on the shaft 22 at an axial location above the first and second impellers 36, 38. The first dispersion ring 40 disperses the liquid medium flow and regulates the amount of liquid medium that graduates to the second cell 14, which results in more efficient scrubbing. The attritioning apparatus 10 also includes baffles 42, which are disposed within the first cell 12. The baffles 42 function to reduce vortexing within the medium, which also contributes to more efficient scrubbing.

As illustrated in FIG. 1, the second cell 14 includes third and fourth impellers 46,48 similar to the first and second impellers 36,38. The third impeller 46 pumps the liquid medium in the first axial direction and the fourth impeller 48 pumps the liquid medium in the second axial direction. The third and fourth impellers 46, 48 are preferably arrange in an opposing relationship along the axis of rotation A, such that they are immediately adjacent to one another. More specifically, the impellers 46,48 may be connected to the rotatable shaft 22 at axial locations within the second cell 14, wherein they are separated by a distance equal to approximately 0.20 $W_{cell}$ to approximately 0.40 $W_{cell}$, where $W_{cell}$ is the width of the second cell 14. More preferably the impellers 46, 48 are separated by a distance of approximately 0.27 $W_{cell}$. The above-describe arrangements of the impellers provide a principal flow direction that is generally parallel to the axis of rotation A. The aforementioned arrangements also assist in the impacting of particles against one another. During operation of the attrition scrubber apparatus 10, the third impeller 46 pumps the liquid medium in the first direction toward the fourth impeller 48, while the fourth impeller 48 pumps the liquid medium in the second direction toward the third impeller 46. This action results in particle-on-particle scrubbing.

The attritioning apparatus 10 also includes a second dispersion ring 50 located on the shaft 22 at an axial location above the third and fourth impellers 46,48. The second dispersion ring 50 disperses the liquid medium flow and regulates the amount of liquid medium that graduates to the top chamber 18, which results in more efficient scrubbing. The attritioning apparatus 10 also includes baffles 44, which are disposed within the second cell 14. Like the baffles 42 of the first cell 12, the baffles 44 function to reduce vortexing within the fluid flow, which also contributes to more efficient scrubbing.

As depicted in FIG. 1, the top chamber 18 contains a lifter impeller 52. The lifter impeller 52 operates to draw the liquid medium from the second cell 14 through a the second orifice plate 30, into the top chamber 18. The liquid medium then exits the attrition scrubber 10 via the outlet 26.

In the preferred embodiment, the first and second attritioning cells 12, 14 each have a width $W_{cell}$. The first, second, third, and fourth impellers 36,38,46,48 each have a diameter $D_i$. The relationship between the attrition cell 12,14 widths $W_{cell}$ and the impeller 36,38,46,48 diameters $D_i$ is $D_i$=0.72$W_{cell}$. In other words, the diameter of the impellers $D_i$ is 72% of the distance of the cell widths $W_{cell.}$ In an alternate embodiment, the first and second attritioning cells 12, 14 are cylindrical and have a diameter $D_{cell}$. The first, second, third, and fourth impellers 36,38,46,48 each have a diameter $D_i$. The relationship between the attrition cell 12, 14 diameters $D_{cell}$ and the impeller 36, 38, 46, 48 diameters $D_i$ is $D_i$=0.72$D_{cell}$. In other words, the diameter of the impellers $D_i$ is 72% of the distance of the cell diameters $D_{cell.}$ In the preferred embodiment, the dispersion rings 40, 50 each have a diameter $D_r$ and the openings in the orifice plates 28, 30 each have a diameter $D_o$. The relationship between the plates 28, 30 and the rings 40, 50 is $D_r$=1.3$D_o$. In other words, the dispersion ring diameters $D_r$ are one and one-third times larger than the orifice plate opening diameters $D_o$.

Figure 2:
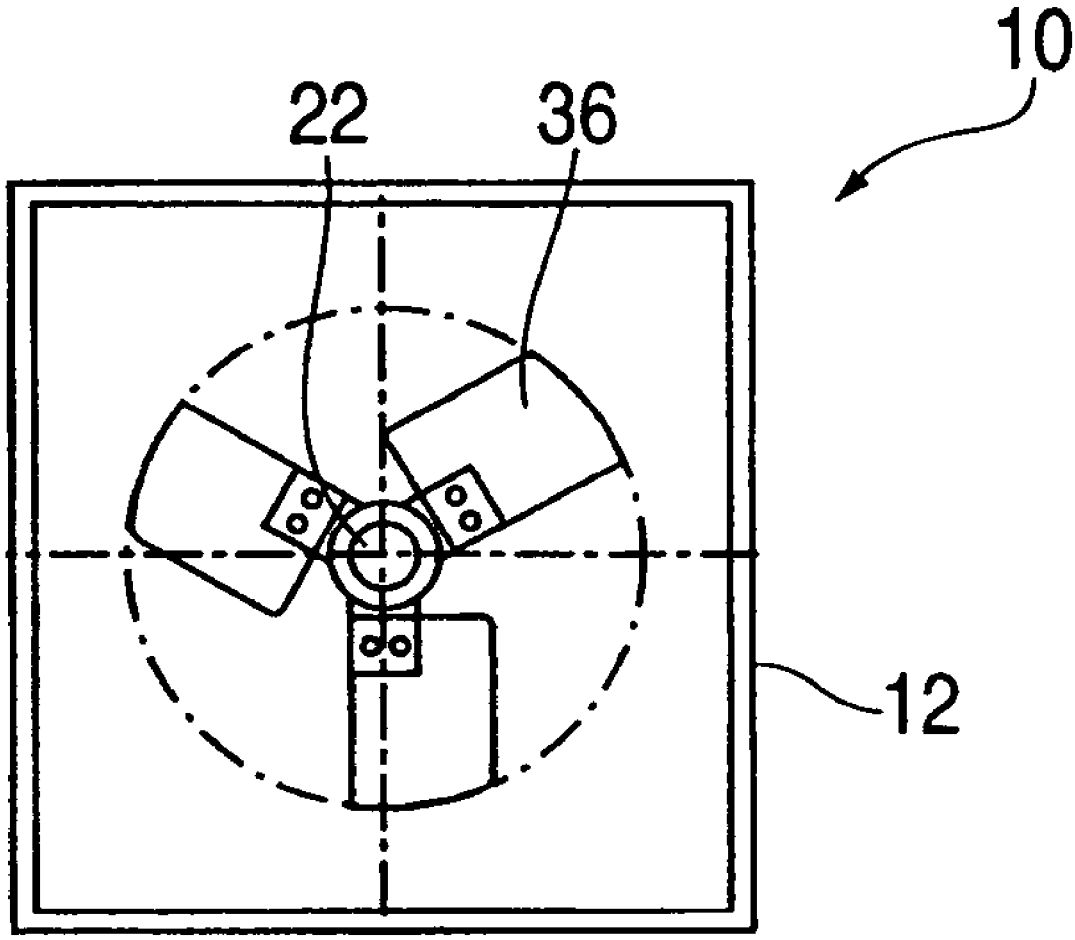
FIG. 2 is a top cross-sectional view the attrition scrubber as depicted in FIG. 1.

FIG. 2 is a transverse cross-sectional view of the first attritioning cell 12 according to the preferred embodiment of the apparatus 10. The respective cross-sections of the first and second attritioning cells 12, 14 are identical to one another, therefore only the first cell 12 is illustrated and discussed. As depicted in FIG. 2, the first cell 12 preferably has a square transverse cross-section, however, cells of varying geometries, such as circular or octagonal cross-sections, may be employed. The shaft 22, to which the first impeller 36 is attached, is disposed in the center of the cell's 12 cross-section. Cells having square transverse cross-sections provide for a scrubber 10 that produces a low degree of swirl and vortexing, which increases the effective scrubbing of the apparatus, while decreasing impeller 36, 38, 46, 48 wear.

Figure 3:
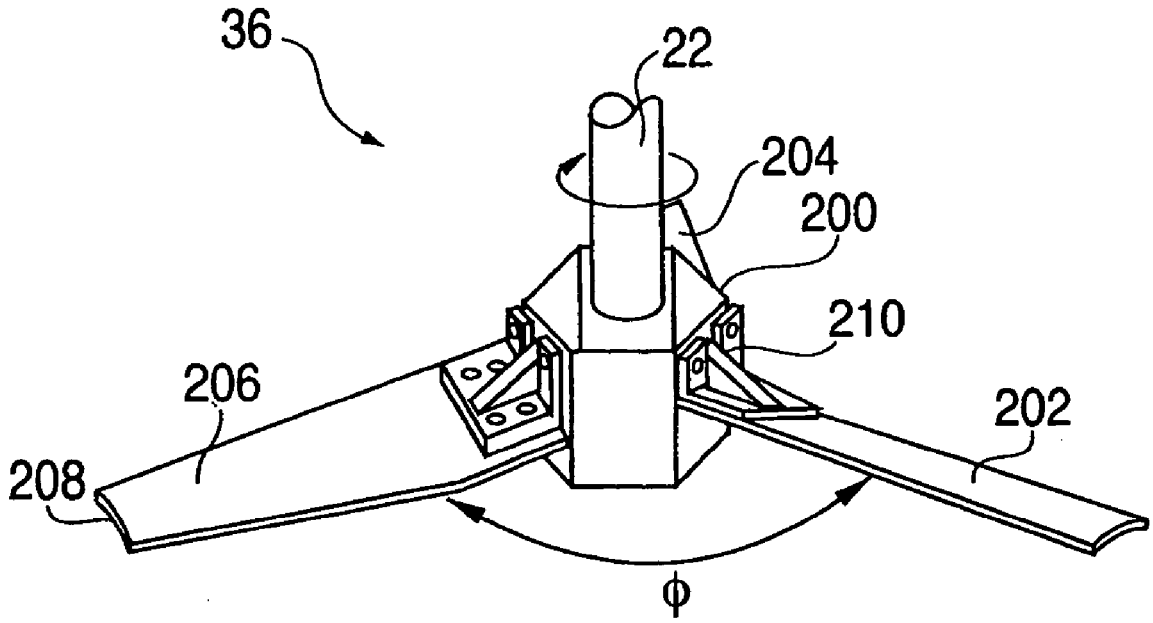
FIG. 3 is a perspective view of an impeller in accordance with yet another preferred embodiment of the present invention.

Referring now to FIG. 3, the impellers 36, 38, 46, 48 are described in detail. The impellers 36, 38, 46, 48 are identical to one another, therefore only the first blade 36 is illustrated and discussed in detail. The impeller 36 is mounted on a hub 200 and includes three blades 202, 204, 206. The blades are disposed along the perimeter of the hub 200 preferably at a one hundred twenty degree angle to one another. The three blades 202, 204, 206 are each similar in shape and orientation to one another. The blades 202, 204, 206 are preferably formed from plates having a constant thickness except at their leading edge which preferably has a rounded profile as depicted in FIG. 3. Each blade has camber which decreases from the tip 208 to the base 210 thereof. The base 210 may be flat to facilitate the attachment of the blades 202, 204,206 to the hub 200. The blades 202, 204, 206 are also oriented and twisted to be at the threshold for flow separation along the width of the blades from the leading to the trailing edge thereof, thereby providing maximum flow in the axial direction before the onset flow separation. The aforementioned orientation and twist of the blades 202, 204, 206 provides a generally constant angle of attack along the entire bade from tip 208 to base 210 and the planform of the blade provides for uniform loading, stability and minimization of fluid forces.

It is desirable to design an attrition scrubber 10 that requires a minimum number of expensive components. For example, because of the present invention's 10 vertical configuration, only one shaft 22 and one drive means 20 are necessary to serve multiple attritioning cells 12, 14. Therefore, the apparatus 10 requires less components than traditional horizontally arranged attrition scrubbers that require one shaft and one drive means per attritioning cell.

It is also desirable to design a scrubber 10 that operates efficiently and therefore cost effectively. For example, efficiency may be expressed by comparing the retention time to the amount of electricity used. Electricity used may be a measurement of the amount of electrical power (Kw) supplied to the drive means 20 during operation. The retention time is the amount of time (minutes) it takes the attrition scrubber 10 to achieve the desired separation among the desired and undesired particles. Because of its unique impellers 36, 38, 46, 48, and because of its unique impeller arrangement, approximately $0.27W_{cell}$, the present invention's 10 power (kW) to retention time (minutes) ratio is more desirable than the power (kW) to retention time (minutes) ratio of traditional scrubbers.

Although an example of the attrition scrubber 10 is depicted utilizing impellers 36, 38, 46, 48, it will be appreciated that other types of impellers can be used. Furthermore, an example of the attrition scrubber 10 is depicted having only first and second cells 12, 14, it will be appreciated that either more or less cells may be employed as desired. Furthermore, although the apparatus 10 is utilized to clean particles it can also be used for, among other things, soil remediation, mineral processing, exposing precious metals to reagents, etc.

Figure 4:
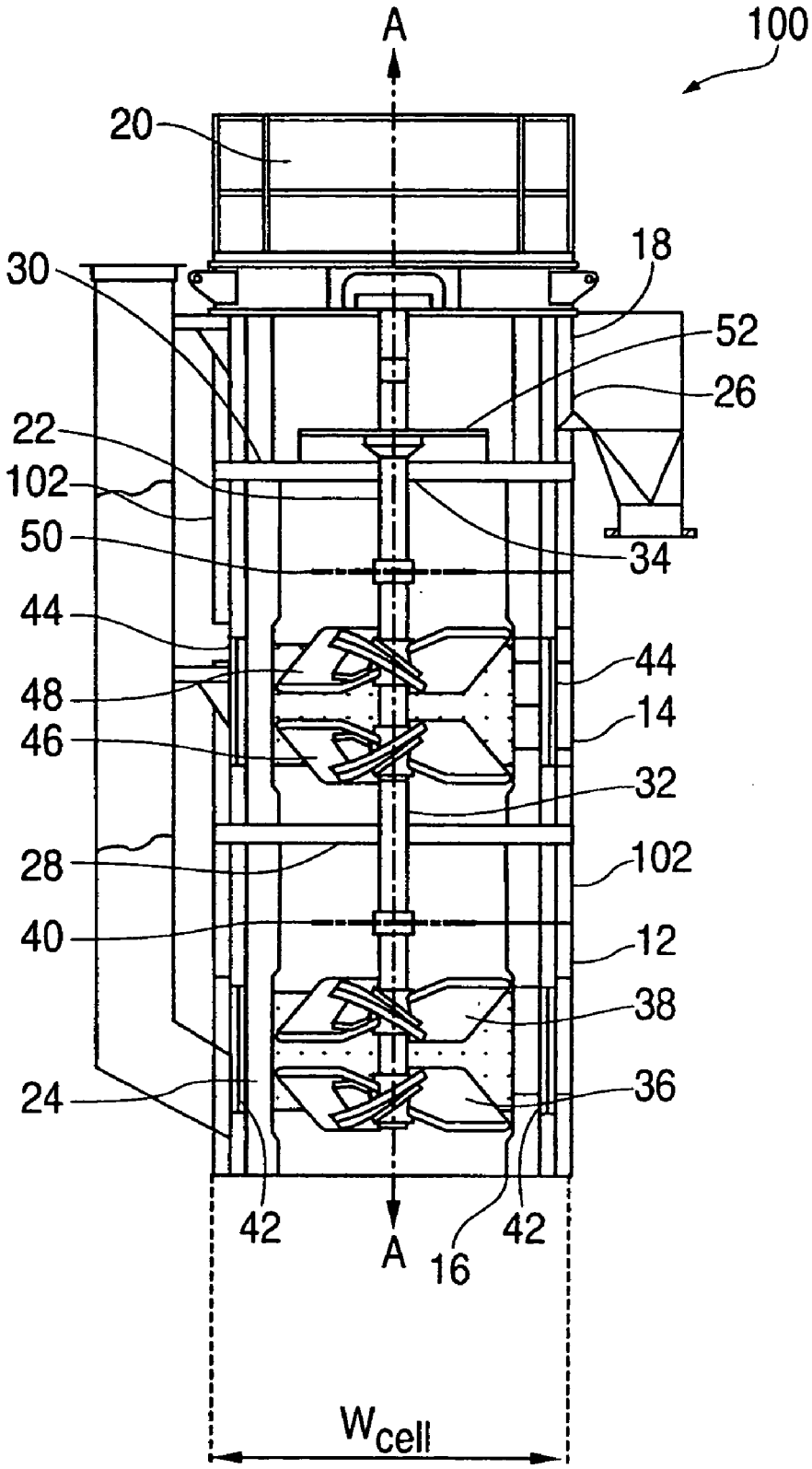
FIG. 4 is a side sectional view of an attrition scrubber in accordance with an alternate embodiment of the present invention.

Referring now to FIG. 4, an attrition scrubber is depicted, generally designated 100, in accordance with an alternative embodiment of the present invention. Whereas the embodiments illustrated and discussed in connection with FIGS. 1–3 are generally square in cross-section, the attrition scrubber apparatus 100 depicted in FIG. 4 has a generally cylindrical cross-section having a generally curved side wall 102.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. An attrition scrubber for attritioning a fluid, having a vertical axis of rotation, comprising:

a first attritioning cell located generally along the vertical axis of rotation having an inlet opening and a width $W_{cell}$;

a second attritioning cell located generally along the vertical axis of rotation at a position adjacently above the first attritioning cell, wherein the second attritioning cell has a width equal to $W_{cell}$;

a rotatable shaft disposed within the first and second attritioning cells, wherein the rotatable shaft extends generally parallel to and rotates about the vertical axis of rotation at least partially all the way between first and second attritioning cells;

a first orifice plate disposed at an axial location between the first and second attritioning cells to separate the first and second attritioning cells from each other, the orifice plate extending radially inward and having a central orifice through which the shaft passes with a clearance to allow fluid flow through the orifice around the shaft from the first attritioning cell to the second attritioning cell;

a first impeller attached to the rotatable shaft at a first axial location within the first attritioning cell, wherein the first impeller pumps fluid along the vertical axis of rotation in a first direction;

a second impeller attached to the rotatable shaft at a second axial location within the first attritioning cell, wherein the second impeller pumps fluid along the vertical axis of rotation in a second, opposite direction;

a third impeller attached to the rotatable shaft at a third axial location within the second attritioning cell, wherein the third impeller pumps fluid along the vertical axis of rotation in the first direction;

a fourth impeller attached to the rotatable shaft at a fourth axial location within the second attritioning cell, wherein the fourth impeller pumps fluid along the vertical axis of rotation in the second, opposite direction, a first dispersion ring disposed in the first attritioning cell, wherein the first dispersion ring is connected to the rotatable shaft at a fifth axial location thereof above the second impeller the fifth axial location being different from the location of the first orifice plate; and a second dispersion ring disposed in the second attritioning cell, wherein the dispersion ring is connected to the rotatable shaft at a sixth axial location thereof above the fourth impeller the sixth axial location being different from the location of the first orifice plate, wherein the first and second dispersion rings each have a diameter $D_r$, wherein the first, second, third, and fourth impellers each have a diameter $D_i$.

2. The apparatus according to claim 1, wherein the first, second, third, and fourth impellers, each comprise:

a hub mounted to the rotatable shaft that rotates with the shaft;

a plurality of blades mounted to the hub, wherein each blade comprises a plate, and wherein each plate comprises:

a constant thickness portion;

a rounded profile;

a leading edge, wherein the rounded profile is located along the leading edge.

3. The apparatus according to claim 1, wherein $D_i=0.72W_{cell}$.

4. The apparatus according to claim 1, wherein the first and second attritioning cells are a plurality of attritioning cells.

5. An apparatus according to claim 1, wherein the first and second impellers are separated by a first distance, and the third and fourth impellers are separated by a second distance.

6. The apparatus according to 5, wherein the first and second distances are equal to approximately $0.27W_{cell}$.

7. The apparatus according to claim 1, wherein the first orifice plate has a first orifice having a diameter $D_o$ extending therethrough.

8. The apparatus according to claim 7, further comprising:

a top chamber having an outlet opening, wherein the top chamber is located generally along the vertical axis of rotation adjacently above the second attritioning cell; and a second orifice plate that separates the top chamber and the second attritioning cell, wherein the second plate has a second orifice having the diameter $D_o$ extending therethrough.

9. The apparatus according to claim 8, wherein $D_r=1.3D_o$.

10. The apparatus according to claim 8, wherein the top chamber comprises a lifter impeller connected to the rotatable shaft at an axial location within the top chamber.

11. The apparatus according to claim 1, further comprising inwardly directed baffles disposed around the inside of the first and second attritioning cells.

12. An attrition scrubber for attritioning a fluid, having a vertical axis of rotation, comprising:

a first attritioning cell located generally along the vertical axis of rotation having an inlet opening and a diameter $D_{cell}$;

a second attritioning cell located generally along the vertical axis of rotation at a position adjacently above the first attritioning cell, wherein the second attritioning cell has a diameter equal to $D_{cell}$;

a rotatable shaft disposed within the first and second attritioning cells, wherein the rotatable shaft extends generally parallel to and rotates about the vertical axis of rotation at least partially all the way between first and second attritioning cells;

a first orifice plate disposed at an axial location between the first and second attritioning cells to separate the first and second attritioning cells from each other, the orifice plate extending radially inward and having a central orifice through which the shaft passes with a clearance to allow fluid flow through the orifice around the shaft from the first attritioning cell to the second attritioning cell;

a first impeller attached to the rotatable shaft at a first axial location within the first attritioning cell, wherein the first impeller pumps fluid along the vertical axis of rotation in a first direction;

a second impeller attached to the rotatable shaft at a second axial location within the first attritioning cell, wherein the second impeller pumps fluid along the vertical axis of rotation in a second, opposite direction;

a third impeller attached to the rotatable shaft at a third axial location within the second attritioning cell, wherein the third impeller pumps fluid along the vertical axis of rotation in the first direction; and a fourth impeller attached to the rotatable shaft at a fourth axial location within the second attritioning cell, wherein the fourth impeller pumps fluid along the vertical axis of rotation in the second, opposite direction, a first dispersion ring disposed at an axial location different from the fifth and sixth locations and in the first attritioning cell, wherein the first dispersion ring is connected to the rotatable shaft at a fifth axial location thereof above the second impeller the fifth axial location being different from the location of the first orifice plate; and a second dispersion ring disposed in the second attritioning cell, wherein the dispersion ring is connected to the rotatable shaft at a sixth axial location thereof above the fourth impeller the sixth axial location being different from the location of the orifice plate, wherein the first and second dispersion rings each have a diameter $D_r$, wherein the first, second, third, and fourth impellers each have a diameter $D_i$.

13. The apparatus according to claim 12, wherein $D_i=0.72D_{cell}$.

14. The apparatus according to claim 12, wherein the first and second attritioning cells are a plurality of attritioning cells.

15. The apparatus according to claim 12, wherein the first and second impellers are separated by a first distance, and the third and fourth impellers are separated by a second distance.

16. The apparatus according to 15, wherein the first and second distances are equal to approximately $0.27D_{cell}$.

17. An attrition scrubber for attritioning a fluid, having a rotatable shaft that rotates about a vertical axis of rotation, wherein the rotatable shaft extends between a first attritioning cell having a width $W_{cell}$ and a second attritioning cell having a width equal to $W_{cell}$ comprising:

means for directing fluid into the first attritioning cell via an inlet, wherein the first attritioning cell comprises:

a first means for pumping the fluid attached to the rotatable shaft at a first axial location within the first attritioning cell; and a second means for pumping the fluid attached to the rotatable shaft at a second axial location within the first attritioning cell;

means for directing the fluid along the vertical axis of rotation into the second attritioning cell, wherein the second attritioning cell comprises:

a third means for pumping the fluid attached to the rotatable shaft at a third axial location within the second attritioning cell; and a fourth means for pumping the fluid attached to the rotatable shaft at a fourth axial location within the second attritioning cell, a first dispersion ring disposed in the first attritioning cell, wherein the first dispersion ring is connected to the rotatable shaft at a fifth axial location thereof above the second impeller; and a second dispersion ring located in the second attritioning cell, wherein the dispersion ring is connected to the rotatable shaft at a sixth axial location thereof above the fourth impeller, a first orifice plate disposed at an axial location different from the fifth and sixth locations and between the first and second attritioning cells to separate the first and second attritioning cells from each other, the orifice plate extending radially inward and having a central orifice through which the shaft passes with a clearance to allow fluid flow through the orifice around the shaft from the first attritioning cell to the second attritioning cell;

wherein the first and second dispersion rings each have a diameter $D_r$, wherein the first, second, third, and fourth means for pumping the fluid each have a diameter $D_i$.

18. The attrition scrubber according to claim 17, wherein $D_i=0.72W_{cell}$.

19. The attrition scrubber according to claim 17, wherein the first and second attritioning cells are a plurality of attritioning cells.

20. The attrition scrubber according to claim 17, wherein the first and second means for pumping the fluid are separated by a first distance, and the third and fourth means for pumping the fluid are separated by a second distance.

21. The attrition scrubber according to 20, wherein the first and second distances are equal to approximately $0.27W_{cell}$.

22. An attrition scrubber for attritioning a fluid, having a vertical axis of rotation, comprising:

a first attritioning cell located generally along the vertical axis of rotation having an inlet opening and a width $W_{cell}$;

a second attritioning cell located generally along the vertical axis of rotation at a position adjacently above the first attritioning cell, wherein the second attritioning cell has a width equal to $W_{cell}$;

a rotatable shaft disposed within the first and second attritioning cells, wherein the rotatable shaft extends generally parallel to and rotates about the vertical axis of rotation between first and second attritioning cells;

a first orifice plate disposed at an axial location between the first and second attritioning cells to separate the first and second attritioning cells from each other, the orifice plate extending radially inward and having a central orifice through which the shaft passes with a clearance to allow fluid flow through the orifice around the shaft from the first attritioning cell to the second attritioning cell;

a first impeller attached to the rotatable shaft at a first axial location within the first attritioning cell, wherein the first impeller pumps fluid along the vertical axis of rotation in a first direction;

a second impeller attached to the rotatable shaft at a second axial location within the first attritioning cell, wherein the second impeller pumps fluid along the vertical axis of rotation in a second, opposite direction;

a third impeller attached to the rotatable shaft at a third axial location within the second attritioning cell, wherein the third impeller pumps fluid along the vertical axis of rotation in the first direction;

a fourth impeller attached to the rotatable shaft at a fourth axial location within the second attritioning cell, wherein the fourth impeller pumps fluid along the vertical axis of rotation in the second, opposite direction, wherein the first, second, third, and fourth impellers each have a diameter $D_i$; and pumping the fluid through a top chamber having an outlet opening, wherein the top chamber is located generally along the vertical axis of rotation adjacently above the second attritioning cell; and a second plate that separates the top chamber and the second attritioning cell, wherein the second plate has a second orifice having the diameter $D_o$ extending therethrough; and a first dispersion ring disposed in the first attritioning cell, wherein the first dispersion ring is connected to the rotatable shaft at a fifth axial location thereof above the second impeller the fifth axial location being different from the location of the first orifice plate; and a second dispersion ring disposed in the second attritioning cell, wherein the dispersion ring is connected to the rotatable shaft at a sixth axial location thereof above the fourth impeller the sixth axial location being different from the location of the first orifice plate, wherein the first and second dispersion rings each have a diameter $D_r$.

* * * * *

UNITED STATES PATENT AND TRADEMARK OFFICE

CERTIFICATE OF CORRECTION

PATENT NO. : 7,168,641 B2
APPLICATION NO. : 10/929566
DATED : January 30, 2007
INVENTOR(S) : Marcos Filgueiras It is certified that error appears in the above-identified patent and that said Letters Patent is hereby corrected as shown below:

Column 10
Lines 6-7, please delete "different from the fifth and sixth locations and".

Signed and Sealed this

Tenth Day of April, 2007

JON W. DUDAS
*Director of the United States Patent and Trademark Office*